US010982622B2

(12) United States Patent
Izawa et al.

(10) Patent No.: US 10,982,622 B2
(45) Date of Patent: Apr. 20, 2021

(54) SLIDING MEMBER, AND SLIDING MEMBER OF INTERNAL COMBUSTION ENGINE

(71) Applicants: NISSAN MOTOR CO., LTD., Yokohama (JP); RENAULT s.a.s., Boulogne-Billancourt (FR)

(72) Inventors: Yoshinori Izawa, Kanagawa (JP); Yutaka Mabuchi, Kanagawa (JP); Junichi Arai, Kanagawa (JP); Christian Grente, Boulogne-Billancourt (FR); Elodie Bonay, Boulogne-Billancourt (FR); Carolina Specht, Boulogne-Billancourt (FR); Jean Marie Mahlaire, Boulogne-Billancourt (FR)

(73) Assignees: NISSAN MOTOR CO., LTD., Yokohama (JP); RENAULT S.A.S., Boulogne-Billancourt (FR)

( * ) Notice: Subject to any disclaimer, the term of this patent is extended or adjusted under 35 U.S.C. 154(b) by 0 days.

(21) Appl. No.: 16/482,609

(22) PCT Filed: Feb. 2, 2018

(86) PCT No.: PCT/IB2018/000148
§ 371 (c)(1),
(2) Date: Jul. 31, 2019

(87) PCT Pub. No.: WO2018/142218
PCT Pub. Date: Aug. 9, 2018

(65) Prior Publication Data

US 2020/0248647 A1 Aug. 6, 2020

(30) Foreign Application Priority Data

Feb. 3, 2017 (JP) ..... 2017-018586

(51) Int. Cl.
*F02F 3/10* (2006.01)
*C22C 30/00* (2006.01)
*C23C 24/04* (2006.01)

(52) U.S. Cl.
CPC ..... *F02F 3/10* (2013.01); *C22C 30/00* (2013.01); *C23C 24/04* (2013.01)

(58) Field of Classification Search
CPC ..... F02F 3/10; C23C 24/04; C22C 30/00
See application file for complete search history.

(56) References Cited

U.S. PATENT DOCUMENTS 5,824,923 A * 10/1998 Kondoh ..... B22F 1/0003 75/247
6,318,327 B1 11/2001 Takahashi et al.
(Continued)

FOREIGN PATENT DOCUMENTS

CN 101890593 B * 2/2013
DE 3520182 A * 6/1985
(Continued)

OTHER PUBLICATIONS

E.P. Georgiou et al., Structural and Tribological Properties of Supersonic Sprayed Fe—Cu—Al—$Al_2O_3$, Nanostructured Cermets, Applied Surface Science, vol. 275, Jan. 23, 2013, pp. 142-147.

*Primary Examiner* — Jacob M Amick
*Assistant Examiner* — Charles Brauch
(74) *Attorney, Agent, or Firm* — Foley & Lardner LLP

(57) ABSTRACT

A sliding member includes a base substrate and a coating layer formed on the base substrate. The coating layer includes a steel portion derived from austenitic stainless steel particles and a copper portion derived from copper particles or copper alloy particles. The steel portion and the copper portion are bonded to each other via an interface between the steel portion and the copper portion.

8 Claims, 16 Drawing Sheets

(56) References Cited

U.S. PATENT DOCUMENTS

| | | | |
|---|---|---|---|
| 7,892,481 | B2 | 2/2011 | Yoshihiro et al. |
| 2004/0182200 | A1 | 9/2004 | Takiguchi et al. |
| 2006/0093736 | A1 | 5/2006 | Raybould et al. |

FOREIGN PATENT DOCUMENTS

| | | | | | |
|---|---|---|---|---|---|
| JP | S55-078736 | U | | 5/1980 | |
| JP | S60-262954 | | | 12/1985 | |
| JP | H08-253856 | | | 10/1996 | |
| JP | 2000-170601 | A | | 6/2000 | |
| JP | 2000170601 | A | * | 6/2000 | ..... C22C 1/0433 |
| JP | 2000-199045 | A | | 7/2000 | |
| JP | 2012-246802 | A | | 12/2012 | |

* cited by examiner

SLIDING MEMBER, AND SLIDING MEMBER OF INTERNAL COMBUSTION ENGINE

TECHNICAL FIELD

The present invention relates to a sliding member and a sliding member of an internal combustion engine.

BACKGROUND ART

Patent Document 1 discloses a forming method for a hard coating, which enables forming a hard coating on a surface of a base substrate by cold state strain-induced transformation. The forming method of this hard coating is a method, in which solid metal powder is sprayed onto a surface of the base substrate using compressed gas as a medium, to form a hard metal coating. In this forming method, the metal powder is made of a metal material that can cause strain-induced transformation, which is slammed onto the base substrate at such a high speed that causes the strain-induced transformation, so that the metal powder is plastically deformed into a flat shape and is deposited as layers on the surface of the base substrate, while also causing strain-induced transformation of the previously deposited metal powder. In this way, the forming method is characterized in that the method forms a metal coating on the surface of the base substrate, in which the coating is harder than the metal powder prior to being slammed onto the base substrate.

PRIOR ART DOCUMENTS

Patent Documents

Patent Document 1: JP 5202024B

SUMMARY OF INVENTION

Technical Problem

However, there has been a problem with the hard coating in Patent Document 1, as being insufficient in wear resistance.

The present invention has been made in view of the aforementioned problem in the prior art. An object of the present invention is to provide a sliding member and a sliding member of an internal combustion engine with excellent wear resistance.

Solution to Problem

The present inventors have conducted an intensive study to achieve the aforementioned object. As a result, the present inventors found that the aforementioned object can be achieved by forming a coating layer on a sliding portion of a base substrate, in which the coating layer has a steel portion derived from austenitic stainless steel particles and a copper portion derived from copper particles or copper alloy particles, the steel portion and the copper portion are bonded to each other via an intermetallic compound layer including an constituent element constituting the steel portion and an constituent element constituting the copper portion at an interface between the steel portion and the copper portion, and the base substrate and the steel portion are bonded via tan intermetallic compound layer at an interface between the base substrate and the steel portion and/or the base substrate and the copper portion are bonded to each other via an intermetallic compound layer at an interface between the base substrate and the copper portion. The present invention has been thus completed.

Advantageous Effect of Invention

According to the present invention, it is possible to provide a sliding member and a sliding member of an internal combustion engine with excellent wear resistance.

DESCRIPTION OF EMBODIMENTS

The following describes in detail of a sliding member and a sliding member of an internal combustion engine, according to an embodiment of the present invention.

First Embodiment

First, a sliding member according to a first embodiment of the present invention will be described in detail, with reference to the drawings. The dimensions of the drawings referred to in the following embodiments are exaggerated for descriptive reasons and may be different from the actual dimensions.

Figure 1:
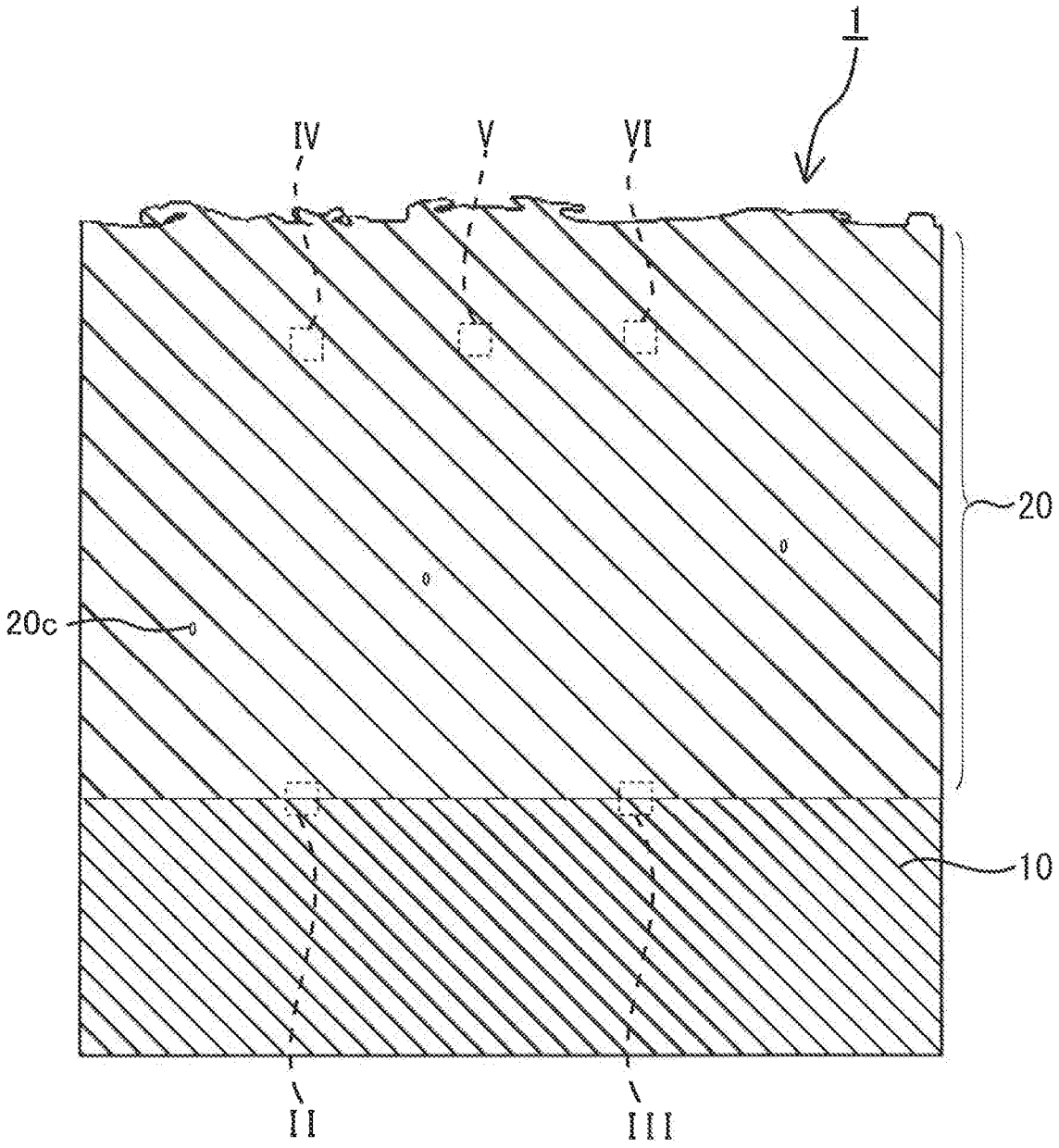
FIG. 1 is a schematic cross-sectional view of a sliding member according to a first embodiment of the present invention.
Figure 2:
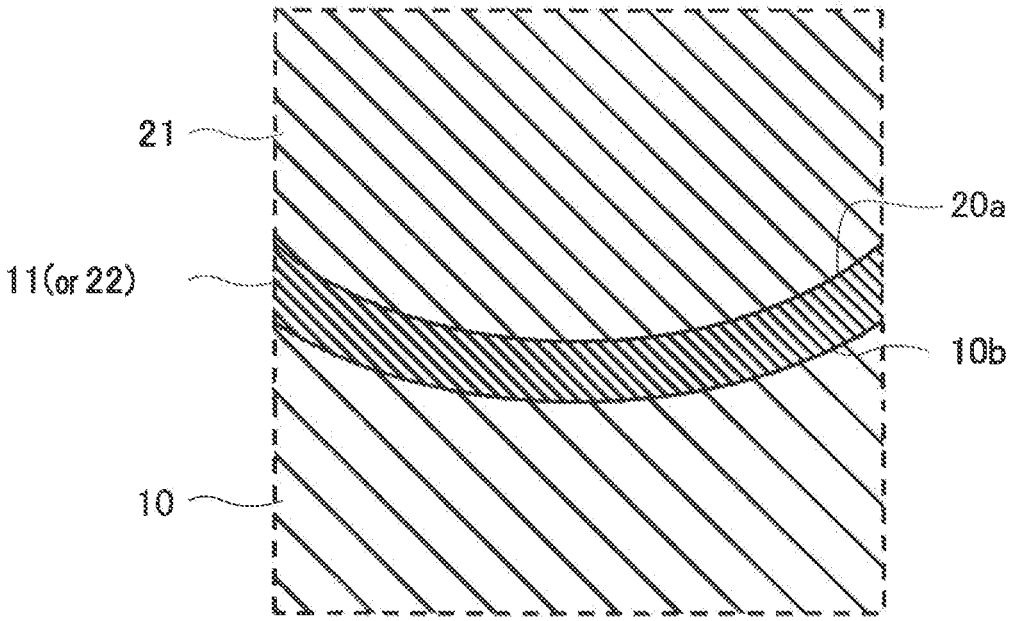
FIG. 2 is an enlarged view of a portion surrounded by the line II of the sliding member shown in FIG. 1.
Figure 3:
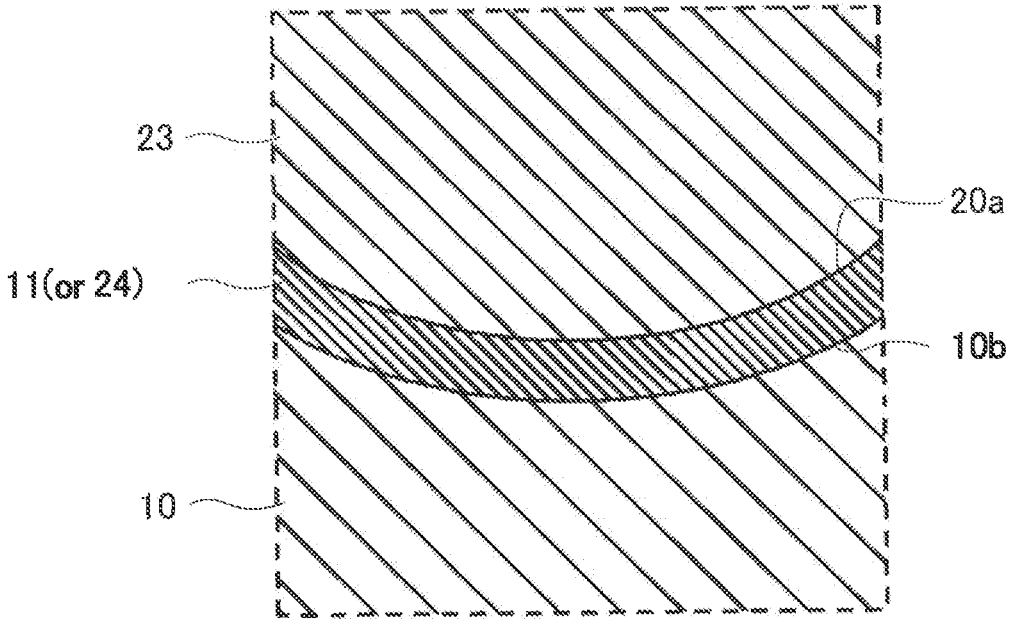
FIG. 3 is an enlarged view of a portion surrounded by the line III of the sliding member shown in FIG. 1.
Figure 4:
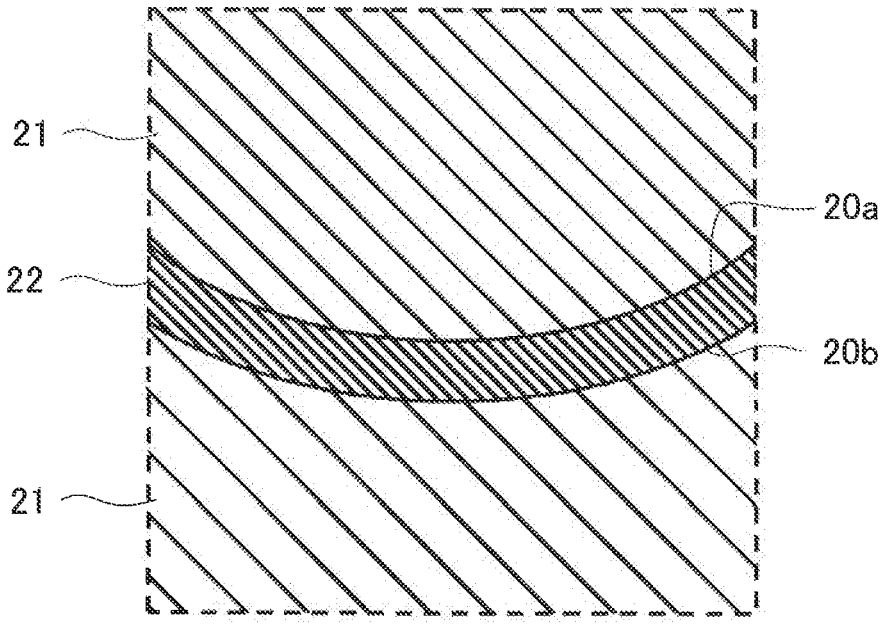
FIG. 4 is an enlarged view of a portion surrounded by the line IV of the sliding member shown in FIG. 1.
Figure 5:
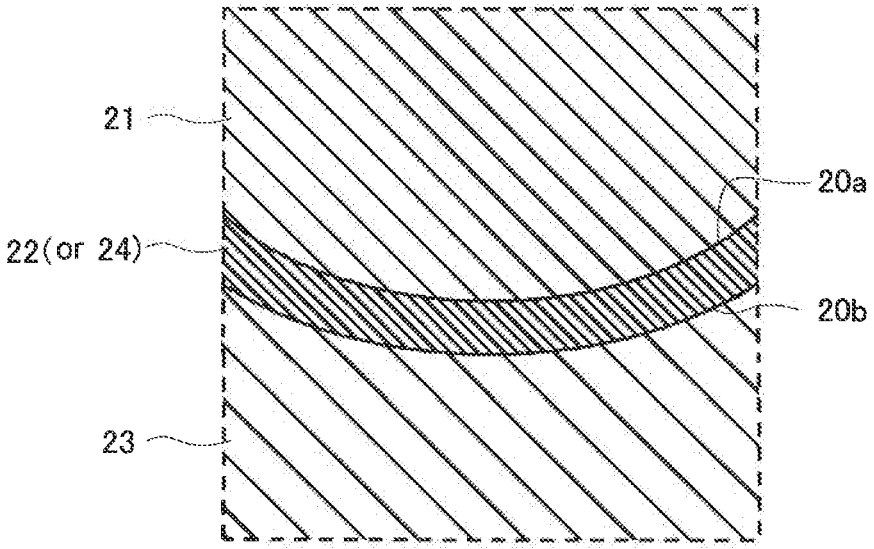
FIG. 5 is an enlarged view of a portion surrounded by the line V of the sliding member shown in FIG. 1.
Figure 6:
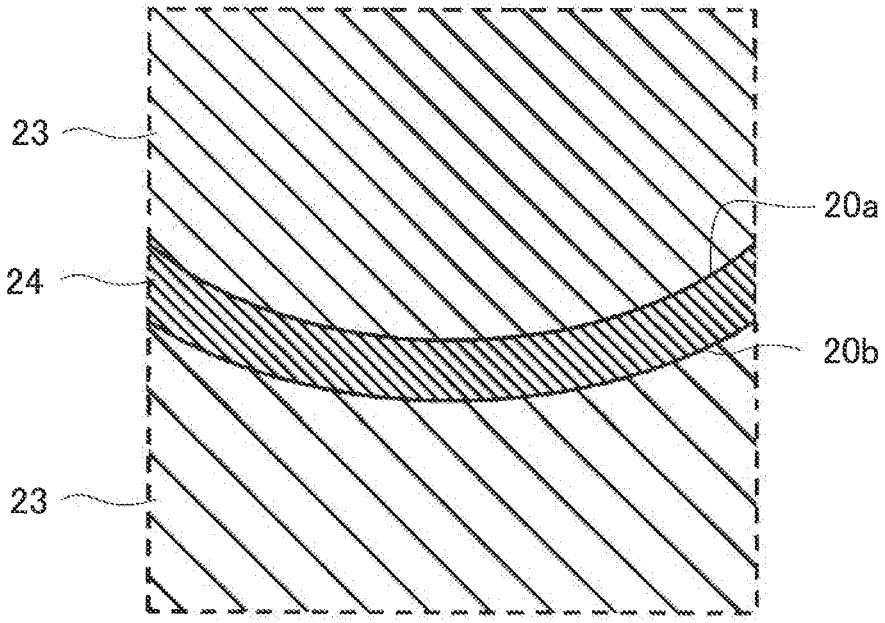
FIG. 6 is an enlarged view of a portion surrounded by the line VI of the sliding member shown in FIG. 1.

FIG. 1 is a schematic cross-sectional view of a sliding member according to the first embodiment of the present invention. FIG. 2 is an enlarged view of a portion surrounded by the line II of the sliding member shown in FIG. 1. FIG. 3 is an enlarged view of a portion surrounded by the line III of the sliding member shown in FIG. 1. FIG. 4 is an enlarged view of a portion surrounded by the line IV of the sliding member shown in FIG. 1. FIG. 5 is an enlarged view of a portion surrounded by the line V of the sliding member shown in FIG. 1. FIG. 6 is an enlarged view of a portion surrounded by the line VI of the sliding member shown in FIG. 1.

As illustrated in FIGS. 1 to 6, a sliding member 1 of the present embodiment includes a base substrate 10, and a coating layer 20 formed on the base substrate 10. The coating layer 20 includes a steel portion 21 derived from austenitic stainless steel particles and a copper portion 23 derived from copper particles or copper alloy particles, and these portions (e.g. a steel portion 21 to another steel portion 21, a steel portion 21 and a copper portion 23, or a copper portion 23 to another copper portion 23) have an interface therebetween. Although not particularly limited, the coating layer 20 may have pores 20*c*.

Furthermore, although not particularly limited, the base substrate 10 may have a plastically deformed portion 10*b* having a flat concave portion, as shown in FIGS. 2 and 3. Although not illustrated, it is needless to say that the scope of the present invention includes a case in which the base substrate does not have the plastically deformed portion having the flat concave portion.

Moreover, although not particularly limited, the coating layer 20 may have a plastically deformed portion 20*a* having a structure, in which a steel portion 21 with a flat shape or a copper portion 23 is accumulated, as shown in FIGS. 2 to 6. Although not illustrated, it is needless to say that the scope of the present invention includes a case in which the coating layer does not have the plastically deformed portion having a structure, in which a steel portion with a flat shape or a copper portion is accumulated.

Furthermore, although not particularly limited, the coating layer 20 may have a plastically deformed portion 20*b*, which has a flat-shaped concave portion, and includes the steel portion 21 and the copper portion 23, and a plastically deformed portion 20*a* having a structure, in which the steel portion 21 with a flat shape or the copper portion 23 is accumulated, as shown in FIGS. 4 to 6. Although not illustrated, it is needless to say that the scope of the present invention includes a case in which the coating layer does not have a plastically deformed portion, which has a flat-shaped concave portion, and includes the steel portion and the copper portion, and a plastically deformed portion having a structure, in which the steel portion with a flat shape or the copper portion is accumulated.

Furthermore, although not particularly limited, at least a part of the base substrate 10 may have a layer 11 being at least one of a diffusion layer and an intermetallic compound layer, at the interface with the coating layer 20, as shown in FIGS. 2 and 3. Although not illustrated, it is needless to say that the scope of the present invention includes a case in which the base substrate does not have the layer being at least one of the diffusion layer and the intermetallic compound layer at the interface with the coating layer.

Moreover, although not particularly limited, at least a part of the steel portion 21, the copper portion 23 may have layers 22, 24 being at least one of a diffusion layer and a intermetallic compound layer, at the interface with the base substrate 10, as shown in FIGS. 2 and 3. Although not illustrated, it is needless to say that the scope of the present invention includes a case in which the steel portion and the copper portion do not have the layer being at least one of the diffusion layer and the intermetallic compound layer, at the interface with the coating layer.

Furthermore, although not particularly limited, at least a part of the steel portion 21 may have the layer 22 being at least one of a diffusion layer and an intermetallic compound layer, at the interface between the steel portions 21,21, as shown in FIG. 4. Although not illustrated, it is needless to say that the scope of the present invention includes a case in which the steel portion does not have the layer being at least one of the diffusion layer and the intermetallic compound layer, at the interface between the steel portions.

Moreover, although not particularly limited, at least a part of the steel portion 21 or the copper portion 23 may have the layers 22, 24 being at least one of a diffusion layer and a intermetallic compound layer, at the interface between the steel portion 21 and the copper portion 23, as shown in FIG. 5. Although not illustrated, it is needless to say that the scope of the present invention includes a case in which the steel portion and the copper portion do not have the layers being at least one of the diffusion layer and the intermetallic compound layer, at the interface between the steel portion and the copper portion.

Moreover, although not particularly limited, at least a part of the copper portions 23 may have the layer 24 being at least one of a diffusion layer and an intermetallic compound layer, at the interface between the copper portions 23, 23, as shown in FIG. 6. Although not illustrated, it is needless to say that the scope of the present invention includes a case in which the copper portions do not have the layer being at least one of the diffusion layer and the intermetallic compound layer, at the interface between the copper portions.

As described above, the sliding member of the present embodiment includes a base substrate, and a coating layer formed on the base substrate, the coating layer has a steel portion derived from austenitic stainless steel particles and a copper portion derived from copper particles or copper alloy particles, and those portions are bonded to each other via the interface therebetween. Accordingly, in comparison with a sliding member having a coating layer only including the steel portion derived from austenitic stainless steel particles as single material, the sliding member of the present embodiment has excellent wear resistance.

Moreover, in the sliding member, at least one of the base substrate and the coating layer preferably has a plastically deformed portion. Due to this, a further excellent wear resistance can be obtained.

Furthermore, in the sliding member, it is preferable that at least a part of at least one type selected from the group consisting of the base substrate, the steel portion and the copper portion has at least one of the diffusion layer and intermetallic compound layer. Due to this, a further excellent wear resistance can be obtained.

It is currently assumed that the aforementioned advantageous effects are achieved based on at least one of the following reasons.

It is considered that the effects are obtained, for example, because the steel particles, as well as the steel particles and base substrate are adhered due to the relatively soft copper particles, when the copper particles or copper alloy particles (hereinafter also referred to as "copper particles") are sprayed onto the base substrate together with the austenitic stainless steel particles (hereinafter also referred to as "steel particles").

It is also considered that the effects are obtained, for example, because adhesion of the steel portions and copper portions to the base substrate is improved, due to an anchor effect caused by sinking of the steel particles and copper particles into the base substrate or into the steel portions or copper portions adhered to the base substrate, when the steel particles and copper particles are sprayed onto the base substrate. In other words, it is also considered that the adhesion of the steel portions and copper portions to the base substrate is improved, due to as the formation of the plastically deformed portion.

Moreover, for example, when the steel particles and copper particles are sprayed onto the base substrate, that kinetic energy is partially converted to thermal energy, which promotes deposition and atomic diffusion occurring between the steel particles, the copper particles and the like and the base substrate. Moreover, the deposition and atomic diffusion occurring between the steel particles, the copper particles and the like and the steel portions, the copper portions and the like adhered to the base substrate may also be promoted. It is considered that, due to this, adhesion between the steel portions, the copper portions and the like and the base substrate, as well as adhesion between these portions, such as the steel portions and copper portions, are improved. In other words, it is also considered that adhesion between the steel portions, the copper portions and the like and the base substrate, as well as adhesion between these portions, such as the steel portions and the copper portions, are improved, due to the formation of at least one of the diffusion layer and intermetallic compound layer in a part of the base substrate or coating layer.

Furthermore, when the steel particles and copper particles are sprayed onto the base substrate, and the steel particles and copper particles collide with the base substrate or with the steel portions or copper portions adhered onto the base substrate, and plastically deform, heat is generated, which promotes deposition and atomic diffusion. It is also considered that, due to this, adhesion between the steel portions, the copper portions and the like and the base substrate, as well as adhesion between these portions, such as the steel portions and the copper portions are improved. In other words, it is also considered that adhesion between the steel portions, the copper portions and the like and the base substrate, as well as adhesion between these portions, such as the steel portions and copper portions, due to the formation of at least one of the diffusion layer and intermetallic compound layer in a part of the base substrate or coating layer.

However, it is needless to say that the scope of the present invention includes cases in which the aforementioned advantageous effects are obtained based on reasons other than the above.

In the present invention, "portions are bonded to each other via an interface therebetween" means that at least one of deposition, atomic diffusion, sinking (penetration) and formation of a plastically deformed portion has occurred between the portions.

The following describes each of the components in further detail.

The base substrate is not particularly limited, however is preferably a metal that is applicable to the method for manufacturing the sliding member, namely, the method for forming the coating layer, which will be described in detail later. Moreover, in case that the sliding member is used as a sliding member of an internal combustion engine, it is needless to say that the base substrate is preferably one usable under a high temperature environment to which the sliding member will be applied.

Examples of metals that are preferably applied include alloys of aluminum, iron, titanium, copper and the like known in the art.

Examples of the aluminum alloys that are preferably applied include AC2A, AC8A, and ADC12 specified in the Japanese Industrial Standards. Examples of the iron alloys that are preferably applied include SUS304 specified in the Japanese Industrial Standards and iron-based sintered alloys. Examples of copper alloys that are preferably applied include beryllium copper and copper-alloy-based sintered alloys.

The porosity of the coating layer is not particularly limited. For example, when the porosity of the coating layer is high, the strength may become insufficient and the wear resistance may decrease accordingly. In this respect, the porosity of the coating layer is preferably as low as possible. Further, in terms of achieving a sliding member having a high thermal conductivity, the porosity of the coating layer in a cross section thereof is preferably 3 area % or less, more preferably 1 area % or less, and particularly 0 area %. Since it is currently possible to reduce the porosity to 0.1 area %, it is preferable to have the porosity ranging from 0.1 area % to 3 area % in terms of achieving excellent wear resistance, improvement in productivity and the like in a good balance. However, it is needless to say that these are not limited to these ranges and may be out of these ranges, as long as the effects of the present invention can be achieved. The porosity of the coating layer in its cross section can be calculated by, for example, observation of a scanning electron microscopic (SEM) image of a cross section of the coating layer, and image processing of the scanning electron microscopic (SEM) image such as binarization.

Furthermore, the thickness of the coating layer is not particularly limited. Namely, the thickness of the coating layer may be suitably adjusted according to the temperature and sliding environment of the portion to which the coating layer is applied. For example, the thickness ranges preferably from 0.05 mm to 5.0 mm, more preferably from 0.1 mm to 2.0 mm. If the thickness of the coating layer is less than 0.05 mm, the rigidity of the coating layer itself becomes insufficient, which may result in plastic deformation particularly when the strength of the base substrate is low. If the thickness of the coating layer is greater than 10 mm, the coating layer may peel off due to the relationship between the residual stress generated in film formation and the interfacial adhesion strength.

Moreover, the austenitic stainless steel contained in the steel portions are not particularly limited as long as they are stainless steel with an austenitic phase. Examples of these steel that are preferably applied include SUS316L and SUS304L specified in the Japanese Industrial Standards. Due to this, excellent wear resistance is achieved.

Furthermore, copper or a copper alloy contained in the copper portions is not particularly limited, as long as it is pure copper or an alloy containing copper by 50 percent by mass or more. For example, pure copper or cupronickel is applicable. Due to this, excellent wear resistance is achieved.

Moreover, although not particularly limited, at least one of the diffusion layer and intermetallic compound layer is one of either the diffusion layer or intermetallic compound layer, or includes both of the diffusion layer and the intermetallic compound layer. Suitable examples of the diffusion layer include those that have a gradient structure in its composition. However, the diffusion layer is not limited to those having a gradient structure in its composition. Moreover, although not particularly limited, suitable examples of those including the intermetallic compound layer include those having a structure, in which the intermetallic compound layer intervenes between diffusion layers having a gradient structure in its composition. The layers, such as the diffusion layer and intermetallic compound layer, for example, include component elements contained in the base substrate, steel portion, copper portion, and the like. Specifically, when aluminum alloy is applied as the base substrate, a layer including an alloy that contains aluminum and copper may be formed. However, the layer is not limited thereto. For example, even when aluminum alloy is applied for the base substrate, a layer including an alloy that contains component elements of aluminum and austenitic stainless steel may be formed. Furthermore, a layer including an alloy that contains component elements of austenitic stainless steel and copper may be formed.

Second Embodiment

Next describes in detail of a sliding member according to a second embodiment of the present invention, with reference to the drawings. Components identical to those described in the aforementioned embodiment will be assigned with the same reference signs, and descriptions thereof will be omitted.

Figure 7:
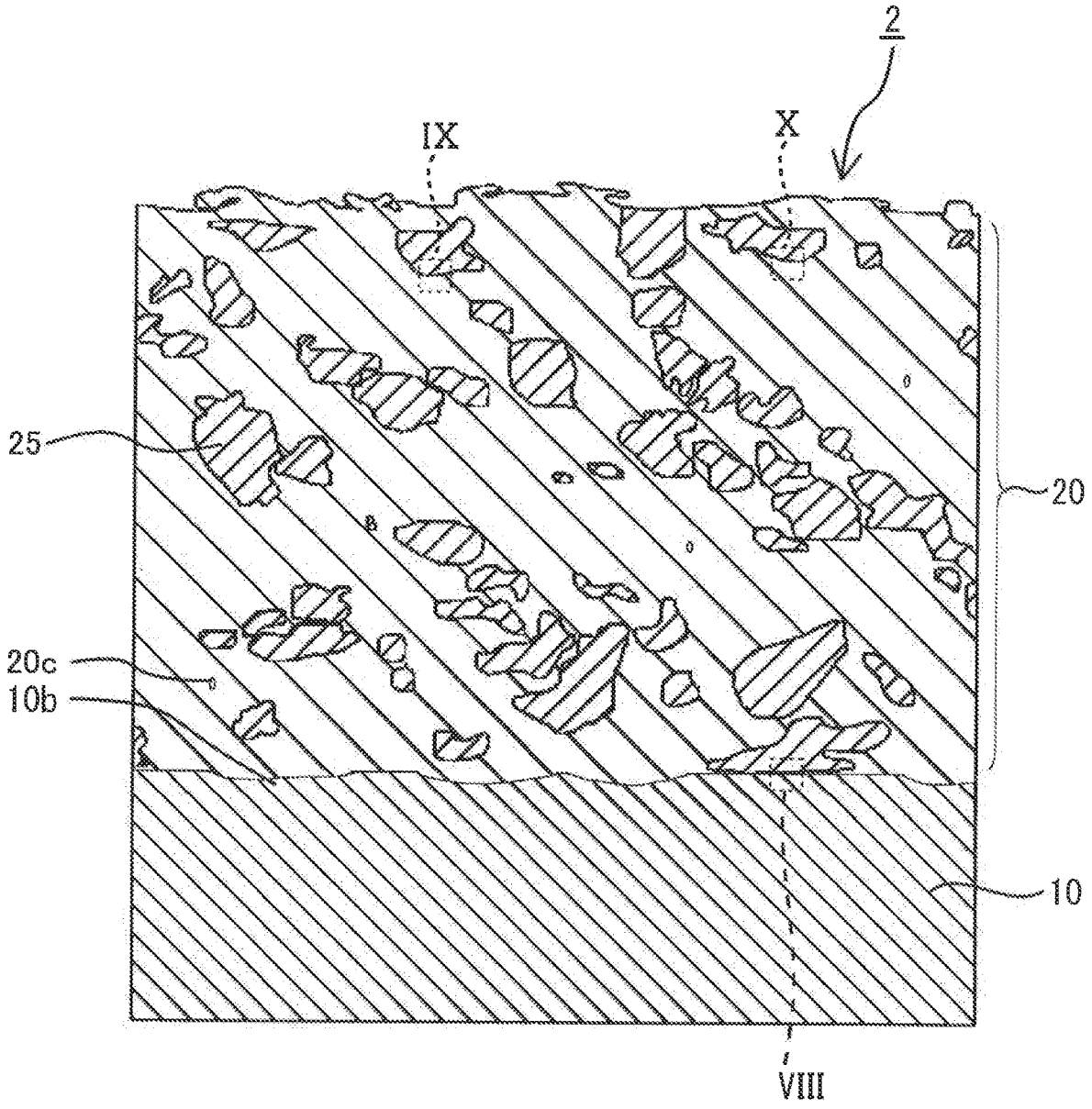
FIG. 7 is a schematic cross-sectional view of a sliding member according to a second embodiment of the present invention.
Figure 8:
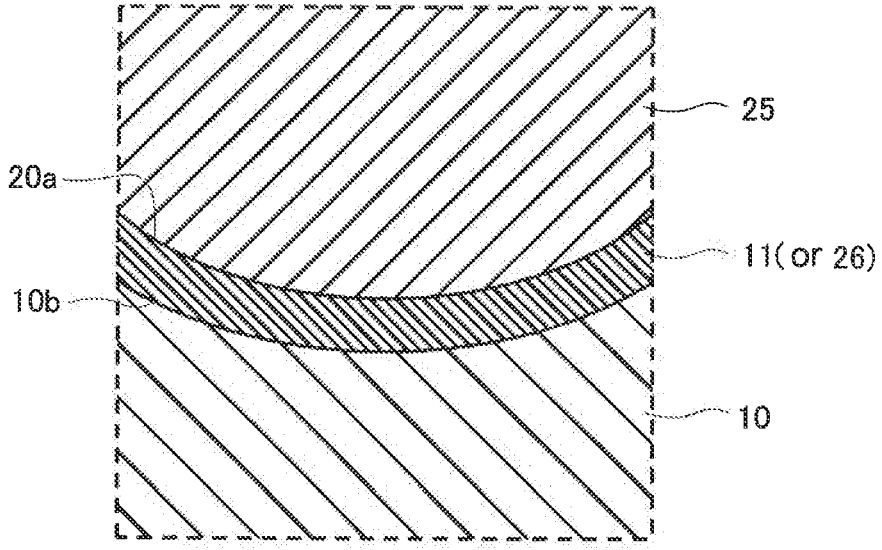
FIG. 8 is an enlarged view of a portion surrounded by the line VIII of the sliding member shown in FIG. 7.
Figure 9:
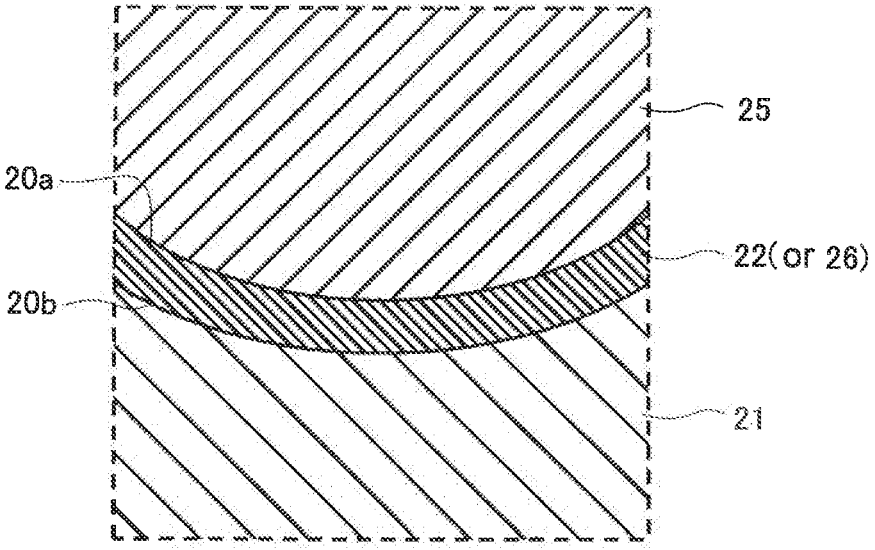
FIG. 9 is an enlarged view of a portion surrounded by the line IX of the sliding member shown in FIG. 7.
Figure 10:
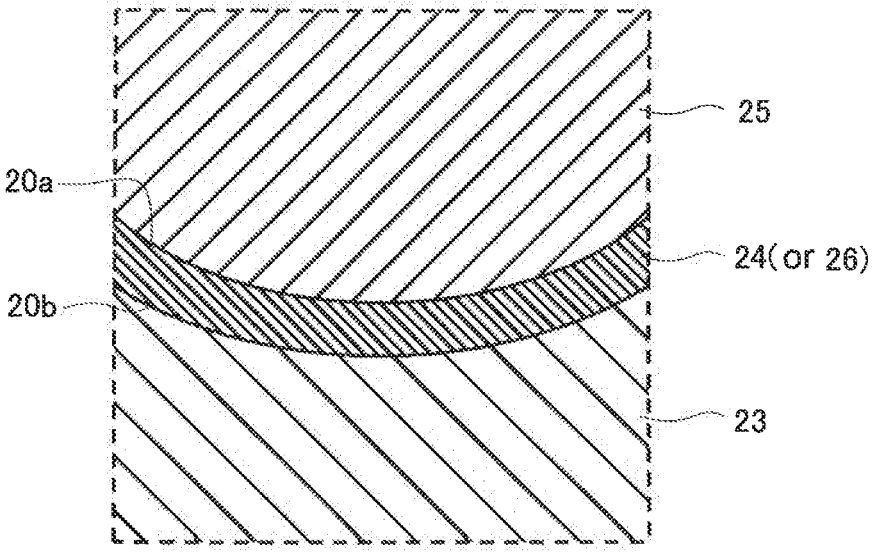
FIG. 10 is an enlarged view of a portion surrounded by the line X of the sliding member shown in FIG. 7.

FIG. 7 is a schematic cross-sectional view of a sliding member according to a second embodiment of the present invention. FIG. 8 is an enlarged view of a portion surrounded by the line VIII of the sliding member shown in FIG. 7. FIG. 9 is an enlarged view of a portion surrounded by the line IX of the sliding member shown in FIG. 7. FIG. 10 is an enlarged view of a portion surrounded by the line X of the sliding member shown in FIG. 7.

As shown in FIGS. 7 to 10, a sliding member 2 of the present embodiment differs from the sliding member of the first embodiment described above in that the coating layer 20 includes a hard particle portion 25 derived from hard particles and is harder than the steel portion 21.

Furthermore, although not particularly limited, the base substrate 10 may have a plastically deformed portion 10*b* having a substantially semi-spherically-shaped concave portion, as shown in FIGS. 7 and 8. Although not illustrated, it is needless to say that the scope of the present invention includes a case in which the base substrate does not have the plastically deformed portion having the semi-spherically-shaped concave portion.

Moreover, although not particularly limited, the coating layer 20 may have a plastically deformed portion 20*a* having a structure, in which the hard particle portion 25 with a spherical shape is deposited, as shown in FIGS. 8 to 10. Although not illustrated, it is needless to say that the scope of the present invention includes a case in which the coating layer does not have the plastically deformed portion having a structure, in which the hard particle portion with a spherical shape is deposited.

Furthermore, although not particularly limited, the coating layer 20 may have a plastically deformed portion 20*b* that includes the steel portion 21 and the copper portion 23 and in which a substantially semi-spherically-shaped concave portion is formed, and a plastically deformed portion 20*a* having a structure, in which the hard particle portion 25 with a spherical shape is deposited, as shown in FIGS. 9 and 10. Although not illustrated, it is needless to say that the scope of the present invention includes a case in which the coating layer does not have the plastically deformed portion that includes the steel portion and the copper portion and in which a substantially semi-spherically-shaped concave portion is formed, and a plastically deformed portion having a structure, in which the hard particle portion with a spherical shape is deposited.

Furthermore, although not particularly limited, at least a part of the base substrate 10 may have a layer 11 of at least one of the diffusion layer and the intermetallic compound layer, at the interface with the hard particle portion 25, as shown in FIG. 8. Although not illustrated, it is needless to say that the scope of the present invention includes a case in which the base substrate does not have the layer of at least one of the diffusion layer and the intermetallic compound layer, at the interface with the hard particle portion.

Moreover, although not particularly limited, at least a part of the hard particle portion 25 may have a layer 26 of at least one of the diffusion layer and the intermetallic compound layer, at the interface with the base substrate 10, as shown in FIG. 8. Although not illustrated, it is needless to say that the scope of the present invention includes a case in which the hard particle portion does not have the layer of at least one of the diffusion layer and the intermetallic compound layer, at the interface with the base substrate.

Furthermore, although not particularly limited, at least a part of the steel portion 21 or hard particle portion 25 may have layers 22, 26 of at least one of the diffusion layer and the intermetallic compound layer, at the interface between the steel portion 21 and the hard particle portion 25, as shown in FIG. 9. Although not illustrated, it is needless to say that the scope of the present invention includes a case in which the steel portions and hard particle portions do not have the layers of at least one of the diffusion layer and the intermetallic compound layer, at the interface between the steel portions and the hard particle portions.

Furthermore, although not particularly limited, at least a part of the copper portion 23 or the hard particle portion 25 may have layers 24, 26 of at least one of the diffusion layer and the intermetallic compound layer, at the interface between the copper portion 23 and the hard particle portion 25, as shown in FIG. 10. Although not illustrated, it is needless to say that the scope of the present invention includes a case in which the copper portions and the hard particle portions do not have the layers of the at least one of the diffusion layer and the intermetallic compound layer, at the interface between the copper portions and the hard particle portions.

As described above, the sliding member of the present embodiment includes a base substrate, and a coating layer formed on the base substrate, and is a sliding member whose coating layer includes a steel portion derived from austenitic stainless steel particles, a copper portion derived from copper particles or copper alloy particles, and a hard particle portion derived from hard particles, and is harder than the steel portion, and these portions are bonded to each other via the interface therebetween. Accordingly, the sliding member of the present embodiment can achieve further excellent wear resistance.

Moreover, in the sliding member, at least one of the base substrate and the coating layer preferably has a plastically deformed portion. Due to this, further excellent wear resistance is achieved.

Furthermore, in the sliding member, it is preferable that at least a part of at least one type selected from the group consisting of the base substrate, the steel portion, the copper portion and the hard particle portion has at least one of the diffusion layer and intermetallic compound layer. Due to this, further excellent wear resistance is achieved.

It is currently assumed that the aforementioned advantageous effects are achieved based on at least one of the following reasons.

For example, it is considered that steel portions and other steel portions, steel portions and hard particle portions, the hard particle portions and other hard particle portions, and further the steel portions, hard particle portions and the like and the base substrate are bonded, by the relatively soft copper portions, when the copper particles and the hard particles that are harder than the copper particles are sprayed onto the base substrate along with the aforementioned steel particles serving as material used in the manufacturing method of the sliding member.

For example, when the base substrate has an oxide coating on the surface that inhibits adhesion between the base substrate and the coating layer, it is further assumed that spraying the steel particles, copper particles and hard particles onto the base substrate, especially the hard particles that are relatively hard, removes the oxide coating to expose and form a new interface of the base substrate that has good adhesion with the coating layer.

Further, for example, when the steel particles, the copper particles and the hard particles are sprayed onto the base substrate, the steel particles, the copper particles and the hard particles sink into the base substrate and the steel portions, the copper portions and the hard particle portions adhered on the base substrate. It is assumed that this anchor effect improves the adhesion between the base substrate and the steel portions, the copper portions, the hard particle portions and the like. In other words, it is considered that the formation of a plastically deformed portion improves the adhesion between the base substrate and the steel portions, the copper portions, the hard particle portions and the like.

Further, for example, when the steel particles, the copper particles and the hard particles are sprayed onto the base substrate, the kinetic energy thereof is partly converted to thermal energy, which promotes deposition and atomic diffusion of the component elements between the base substrate and the steel portions, the copper portions, the hard particle portions and the like. In addition, deposition and atomic diffusion between the steel portions, the copper portions, the hard particle portions and the like and those adhered on the base substrate can be promoted. It is assume that, due to this, adhesion between the base substrate and the steel portions, the copper portions, the hard particle portions and the like, as well as adhesion between these portions, such as the steel portions, the copper portions, the hard particle portions and the like, are improved. In other word, it is assumed that at least one of the diffusion layer and the intermetallic compound layer is formed at least in a part of the base substrate and the coating layer, which improves adhesion between the base substrate and the steel portions, the copper portions, the hard particle portions and the like, as well as adhesion between these portions, such as the steel portions, the copper portions, the hard particle portions and the like.

Further, for example, when the steel particles, the copper particles, the hard particles and the like are sprayed onto the base substrate, the steel particles, they collide with the base substrate and the steel particles, the copper particles the hard particles and the like adhered on the base substrate, heat is generated during plastic deformation and deposition and atomic diffusion proceed. It is assumed that, due to this, adhesion between the base substrate and the steel portions, the copper portions, the hard particle portions and the like, as well as adhesion between these portions, such as the steel portions, the copper portions, the hard particle portions and the like, are improved. In other word, it is assumed that at least one of the diffusion layer and the intermetallic compound layer is formed at least in a part of the base substrate and the coating layer, which improves adhesion between the base substrate and the steel portions, the copper portions, the hard particle portions and the like, as well as adhesion between these portions, such as the steel portions, the copper portions, the hard particle portions and the like.

However, it is needless to say that the scope of the present invention includes cases in which the aforementioned advantageous effects are obtained based on reasons other than the above.

The following describes each of the components in further detail.

The hard particle portion is not particularly limited as long as they are harder than the steel portion. For example, alloy particles or ceramics particles, or alternatively a mixture containing these at any proportion are applicable as the hard particles. Moreover, although not particularly limited, for example, the hard particle portion is preferably harder than the base substrate. Furthermore, for example, as the alloy particles, it is preferable to apply iron-based alloy particles, cobalt-based alloy particles, chromium-based alloy particles, nickel-based alloy particles, or molybdenum-based alloy particles, or alternatively a mixture containing these particles at any proportion.

For example, the Vickers hardness measured and calculated according to the Vickers hardness test defined in the Japanese Industrial Standards (JIS Z 2244) may be used as an indicator of hardness of the steel portion and the hard particle portion. Moreover, an arithmetic mean value is used as the Vickers hardness, the arithmetic mean value being obtained by measuring approximately three to thirty positions, at least three to five positions, for the steel portion and hard particle portion in the coating layer. Furthermore, when measuring and calculating the Vickers hardness of the steel portion and the hard particle portion, observations of scanning electron microscope (SEM) images and transmission electron microscope (TEM) images, and energy dispersive X-ray (EDX) spectrometry and the like may be combined, if necessary.

Specific examples of the iron-based alloy include hard iron-based alloys such as Fe-28Cr-16Ni-4.5Mo-1.5Si-1.75C. Specific examples of the cobalt-based alloy include hard cobalt-based silicide alloys such as TRIBALOY (registered trademark) T-400, or hard cobalt-based carbide alloy such as Stellite (registered trademark) 6. Specific examples of the nickel-based alloy include hard nickel-based alloys such as Ni700 (registered trademark) (Ni-32Mo-16Cr-3.1Si).

Although not particularly limited, the proportion of the hard particle portion in the cross section of the coating layer, in terms of improving the wear resistance and also the thermal conductivity depending on the needs, ranges preferably from 1 area % to 50 area %, more preferably from 10 area % to 50 area %, still more preferably from 10 area % to 40 area %. However, it is needless to say that these are not limited to these ranges and may be out of these ranges as long as the effects of the present invention can be achieved. The proportion of the hard particle portion in the cross section of the coating layer can be calculated by, for example, observation of a scanning electron microscopic (SEM) image of the cross section of the coating layer, and image processing of the scanning electron microscopic (SEM) image such as binarization. Moreover, it is needless to say that area % calculated by observation of a cross section can be regarded as volume %, and volume % can be converted to weight % using the density of the particles.

As described above, the proportion of the hard particle portion in the cross section of the coating layer ranges preferably from 1 area % to 50 area % in terms of improving the wear resistance and the thermal conductivity. However, for an application that does not essentially require high thermal conductivity but requires excellent wear resistance, the proportion of the hard particle portion in the cross section of the coating layer may range from 50 area % to 99 area %.

Moreover, although not particularly limited, at least one of the diffusion layer and the intermetallic compound layer is one of either the diffusion layer or the intermetallic compound layer, or includes both of the diffusion layer and intermetallic compound layer. Suitable examples of the diffusion layer include those that have a gradient structure in its composition. However, the diffusion layer is not limited to those having a gradient structure in its composition. Moreover, although not particularly limited, suitable examples of those including the intermetallic compound layer include those having a structure, in which the intermetallic compound layer intervenes between diffusion layers with a gradient structure in its composition. The layers such as the diffusion layer and the intermetallic compound layer, for example, include of component elements contained in the base substrate, the copper portion, the hard particle portion and the like. Specifically, when aluminum alloy is applied as the base substrate, a layer having an alloy that contains aluminum and copper may be formed. However, the layer is not limited thereto. For example, even when aluminum alloy is applied for the base substrate, a layer having made an alloy that contains aluminum and the component elements of hard particle portion may be formed.

Another Embodiment

Next, a sliding member according to another embodiment of the present invention will be described in detail, with reference to the drawings. Components identical to those described in the aforementioned embodiment will be assigned with the same reference signs, and descriptions thereof will be omitted.

Figure 11:
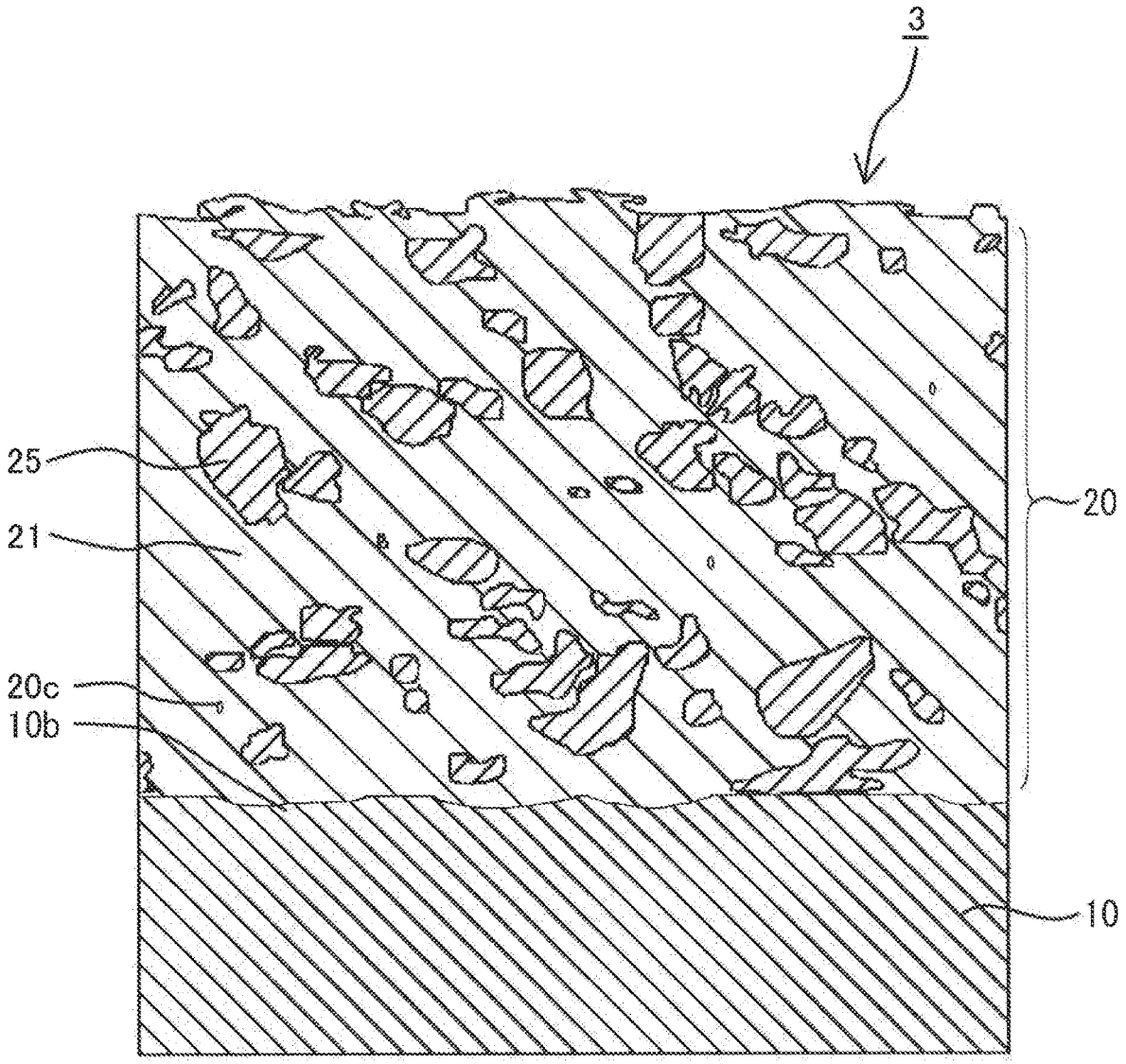
FIG. 11 is a schematic cross-sectional view of a sliding member according to another embodiment of the present invention.

FIG. 11 is a schematic cross-sectional view of a sliding member according to another embodiment of the present invention. As shown in FIG. 11, the sliding member 3 of the present embodiment differs from the sliding member of the first or second embodiment described above in that the coating layer 20 includes the steel portion 21 derived from austenitic stainless steel particles and the hard particle portion 25 derived from hard particles, and the hard particle portion is harder than the steel portion 21, and that no copper portion 23 is contained. Compared to the sliding member of the first or second embodiment, the coating layer 20 likely has pores 20*c*.

As described above, the sliding member of the present embodiment includes a base substrate, and a coating layer formed on the base substrate, and is a sliding member whose coating layer has a steel portion derived from austenitic stainless steel particles and a hard particle portion derived from hard particles, and the hard particle is harder than the steel portion, and these portions are bonded to each other via the interface therebetween. Accordingly, in comparison to a sliding member having a coating layer only composed of the steel portion derived from austenitic stainless steel particles as a single material, the sliding member of the present embodiment has excellent wear resistance. A more exceling wear resistance can be achieved when the steel portion and the copper portion are provided compared with the case in which the steel portion and the hard particle portion are provided.

Third Embodiment

Next, a sliding member according to a third embodiment of the present invention, namely, a sliding member having the aforementioned sliding member in a sliding portion, will be described with reference to the drawings. As the sliding member, a sliding member of an internal combustion engine is raised as an example to describe the embodiment in detail, however it is not particularly limited to this. It is also needless to say that a front surface side of the coating layer serves as a sliding surface. Components identical to those described in the aforementioned embodiment will be assigned with the same reference signs, and descriptions thereof will be omitted.

Figure 12:
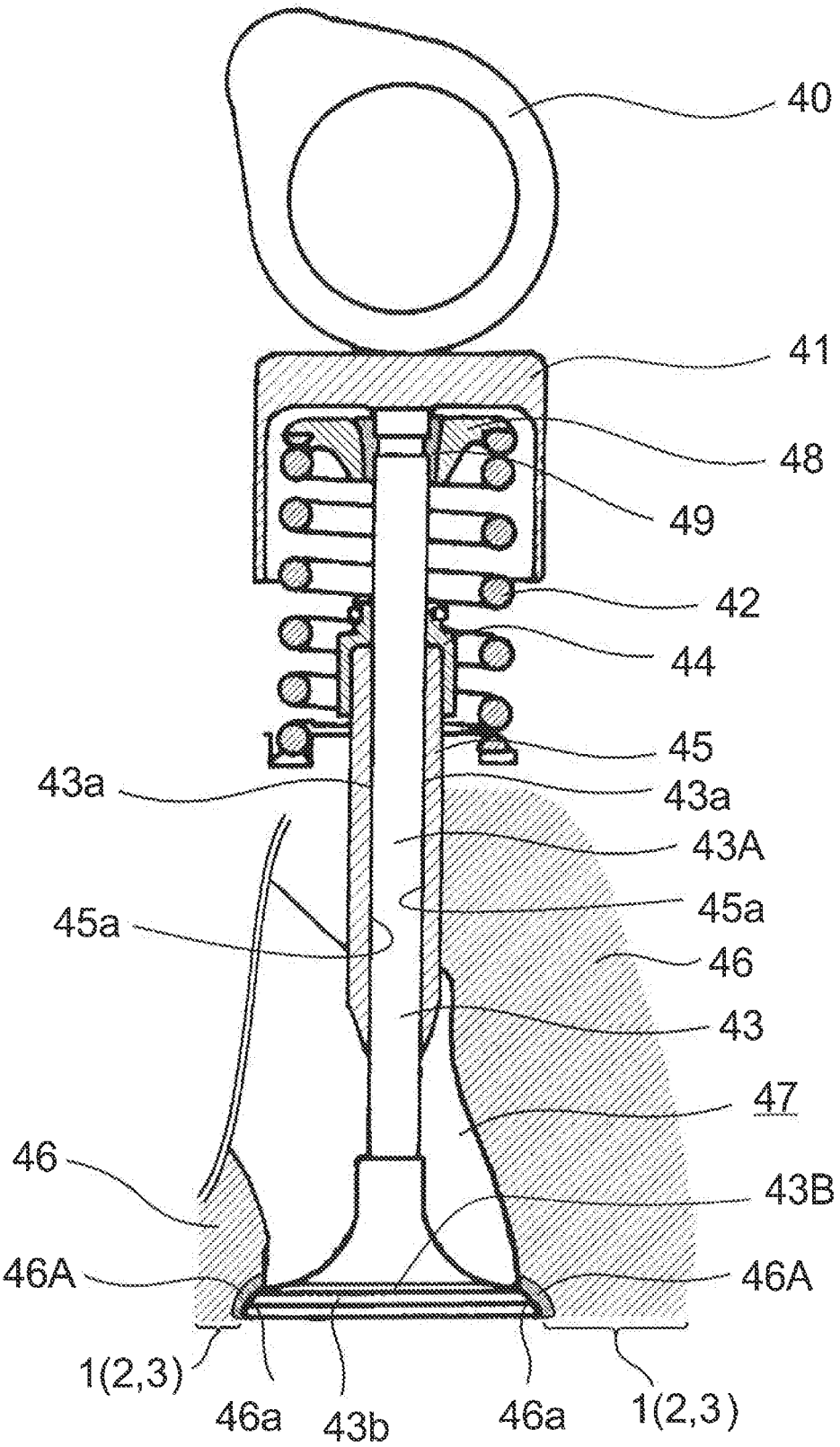
FIG. 12 is a schematic cross-sectional view of a sliding member of an internal combustion engine that includes the sliding member in a sliding portion of the internal combustion engine.

FIG. 12 is a schematic cross-sectional view of the sliding member of the internal combustion engine that includes the sliding member in a sliding portion of the internal combustion engine. To be more specific, FIG. 12 is a schematic cross-sectional view of a valve actuating mechanism including an engine valve. As illustrated in FIG. 12, when a cam lobe 40 rotates, a valve lifter 41 is pushed down while a valve spring 42 is compressed. Simultaneously, an engine valve 43 is pushed down by being guided by a valve guide 45 having a stem seal 44. As a result, the engine valve 43 separates from a seat portion 46A for the engine valve 43 of a cylinder head 46 so that an exhaust port 47 communicates with a combustion chamber (not illustrated) (the engine valve open state). Thereafter, a further rotation of the cam lobe 40 causes the valve lifter 41, a retainer 48 and a cotter 49 to be pushed up along with the engine valve 43 due to a repulsion force of the valve spring 42. As a result, the engine valve 43 contacts the seat portion 46A so that the exhaust port 47 is shut off from the combustion chamber (not illustrated) (the engine valve closed state). The engine valve 43 opens and closes in synchronization with the rotation of the cam lobe 40 in such way. As such, the valve stem 43A of the engine valve 43, while being lubricated with oil, is inserted through the valve guide 45 that is press-fitted on the cylinder head 46 side. A valve face 43B of the engine valve 43, which serves as an on-off valve of the combustion chamber (not illustrated), is in or out of contact with the seat portion 46A for the engine valve 43 of the cylinder head 46 during operation. While FIG. 12 illustrates the exhaust port 47 side, the sliding member of the present invention may also be applied on an intake port side (not illustrated).

The aforementioned sliding member, on which the coating layer is formed, for example, the aforementioned sliding member (1, 2, 3) according to the first to another embodiments, is applied to the cylinder head and a sliding surface 46*a* of the seat portion 46A for the engine valve of the cylinder head, in which the sliding surface 46*a* is a sliding portion of the engine valve. Accordingly, the sliding member has excellent wear resistance as compared to the sliding member with the coating layer only composed of the steel portion derived from austenitic stainless steel particles as a single material. Moreover, by applying the sliding member of the present invention to the cylinder head, it is possible to eliminate the press-fit valve seat. As a result, it is possible to flexibly design the shape of the exhaust port and intake port and expand the diameter of engine valves, which can improve fuel consumption, power output, torque and the like of engines.

Although not shown in the Figures, the sliding member with the aforementioned coating layer, for example, the sliding member according to the first to another embodiments, is also applicable to, for example, one or both of the sliding surfaces of the valve stem and a counterpart valve guide, and/or, at least one position selected from the group consisting of the sliding surface of a valve stem end, the sliding surface of the valve face and the sliding surface of the press-fitted valve seat. Accordingly, the sliding member has excellent wear resistance as compared to the sliding member with the coating layer only composed of the steel portion derived from austenitic stainless steel particles as a single material.

That is, the cylinder head of the present embodiment preferably includes the sliding member of the aforementioned embodiments in the seat portion for the engine valve. Another cylinder head of the present embodiment is a cylinder head including a valve seat having the sliding member of the aforementioned embodiments, and preferably has the sliding member in the seat portion for the engine valve of the valve seat. Furthermore, the valve seat of the present embodiment preferably has the sliding member of the aforementioned embodiments included in the seat portion for the engine valve. The engine valve of the present embodiment preferably also includes the sliding member of the aforementioned embodiments in the valve face. Furthermore, another engine valve of the present embodiment preferably includes the sliding member of the aforementioned embodiments in a sliding portion against the valve guide.

Fourth Embodiment

Next, a sliding member according to a fourth embodiment of the present invention will be described in detail, with reference to the drawings. It is needless to say that a front surface side of the coating layer serves as a sliding surface. Components identical to those described in the aforementioned embodiment will be assigned with the same reference signs, and descriptions thereof will be omitted.

Figure 13:
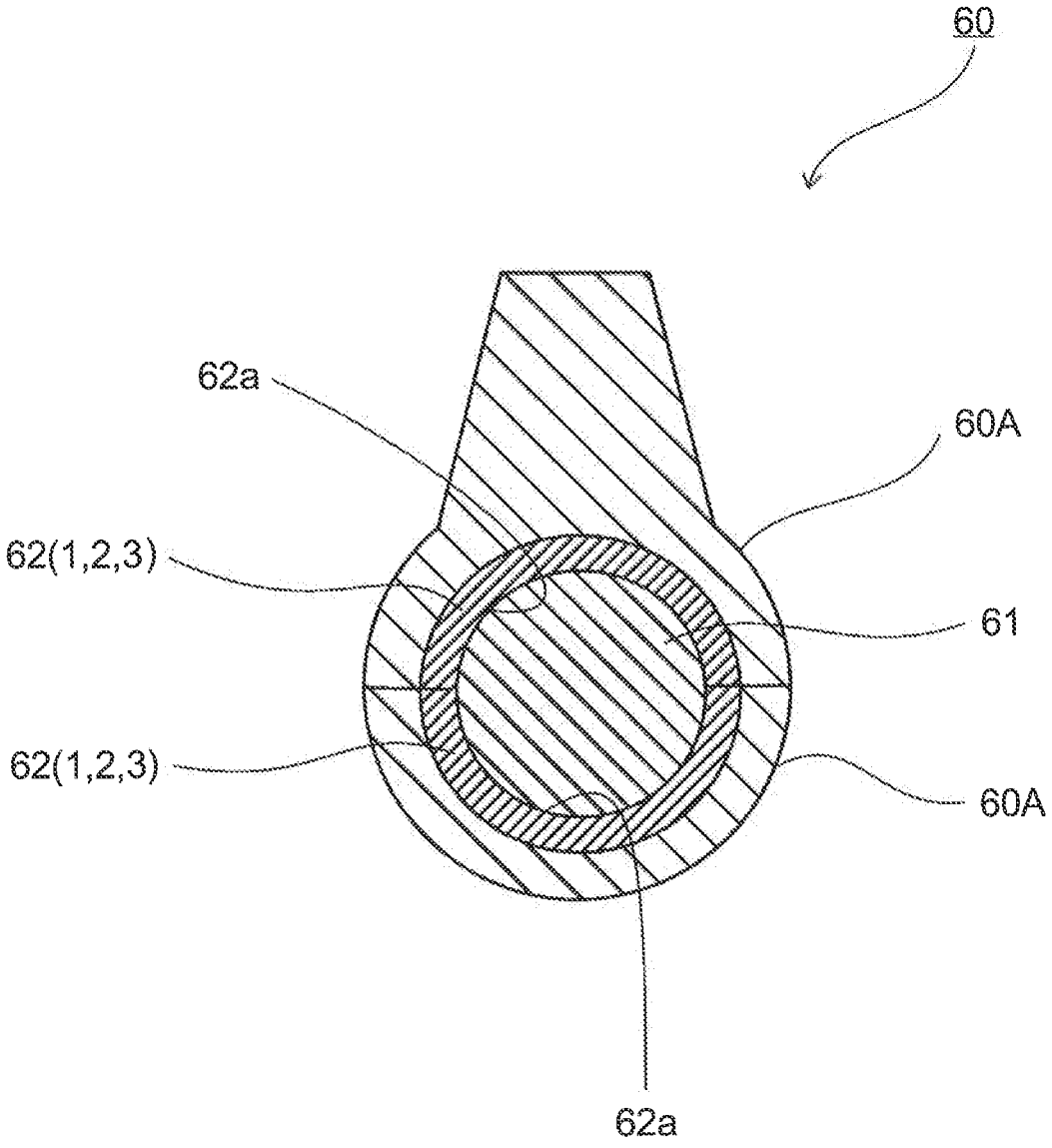
FIG. 13 is a schematic cross-sectional view of a bearing mechanism of an internal combustion engine that has a sliding member in a bearing metal of the bearing mechanism of the internal combustion engine.

FIG. 13 is a schematic cross-sectional view of a bearing mechanism of an internal combustion engine that includes the sliding member in a bearing metal of the bearing mechanism of the internal combustion engine. To be more specific, FIG. 13 is a schematic cross-sectional view of the bearing metal that serves as a sliding member of a connecting rod. As illustrated in FIG. 13, a big end portion 60A of the connecting rod 60, which is located on a crank side (not shown), is divided into two, upper and lower parts. On the big end portion 60A are disposed a bearing metal 62 divided into two for supporting a crank pin 61.

The sliding member with the aforementioned coating layer, for example, the sliding member (1, 2, 3) according to the aforementioned first to another embodiments, is applied to sliding surfaces 62*a* as the bearing metals 62. Accordingly, the sliding member has excellent wear resistance as compared to the sliding member with the coating layer only composed of the steel portion derived from austenitic stainless steel particles as a single material.

Although not shown in the figures, the aforementioned sliding member with the coating layer formed thereon, for example, the sliding member according to the aforementioned first to another embodiments, is also applicable to the sliding surface of the bearing metal divided in two for supporting a piston pin of the connecting rod, which is located at a small end portion on a piston side (not shown). Accordingly, the sliding member has excellent wear resistance as compared to the sliding member with the coating layer only composed of the steel portion derived from austenitic stainless steel particles as a single material.

That is, the bearing mechanism of the internal combustion engine of the present embodiment preferably includes the sliding member of the aforementioned embodiments in the bearing metal of the bearing mechanism of the internal combustion engine. It is also possible to directly form the layer (directly form without using metal) on the sliding surface on the big end side of the connecting rod. Moreover, it is also possible to directly form the layer (directly form without using a metal) on the sliding surface on the small end side of the connection rod.

The sliding member of the internal combustion engine of the present embodiment may also be applied to a piston ring and a piston. Namely, it is preferable to apply the coating layer on the surface of the piston ring. Moreover, it is preferable to apply the coating layer on a ring groove inner surface of the piston. Furthermore, in the sliding member of the internal combustion engine of the present embodiment, it is preferable to apply the coating layer on an inner surface of a cylinder bore (this may serve as an alternative to the cylinder liner, or an alternative for bore thermal spraying). Moreover, in the sliding member of the internal combustion engine of the present embodiment, it is preferable to apply the coating layer on a metal of a journal of a crank shaft. Furthermore, in the sliding member of the internal combustion engine of the present embodiment, it is preferable to directly form the coating layer (directly form the coating layer without using a metal) onto the metal portion of the journal of the crank shaft. Moreover, in the sliding member of the internal combustion engine of the present embodiment, it is preferable to apply the coating layer on a surface of a metal of the journal of the camshaft. Furthermore, in the sliding member of the internal combustion engine of the present embodiment, it is preferable to directly form the coating layer (directly form the coating layer without using a metal) onto the metal portion of the journal of the camshaft. Moreover, in the sliding member of the internal combustion engine of the present embodiment, it is preferable to apply the coating layer on a cam lobe surface of the camshaft. Furthermore, in the sliding member of the internal combustion engine of the present embodiment, it is preferable to apply the coating layer on a metal of the piston and the piston pin. Moreover, in the sliding member of the internal combustion engine of the present embodiment, it is preferable to directly form the coating layer on a metal portion of the piston and the piston pin. Furthermore, in the sliding member of the internal combustion engine of the present embodiment, it is preferable to apply the coating layer on a surface of a piston skirt. Moreover, in the sliding member of the internal combustion engine of the present embodiment, it is preferable to apply the coating layer on a crown surface of a valve lifter. Furthermore, in the sliding member of the internal combustion engine of the present embodiment, it is preferable to apply the coating layer on a side surface of the valve lifter. Moreover, in the sliding member of the internal combustion engine of the present embodiment, it is preferable to apply the coating layer on a sliding surface against a valve lifter of a lifter bore in the cylinder head. Furthermore, in the sliding member of the internal combustion engine of the present embodiment, it is preferable to apply the coating layer on a surface of teeth of a sprocket (in this case, for example, the coating layer is formed on a sprocket made of aluminum sintered alloy instead of a sprocket made of iron sintered alloy). Moreover, in the sliding member of the internal combustion engine of the present embodiment, it is preferable to apply the coating layer to pins of a chain. Furthermore, in the sliding member of the internal combustion engine of the present embodiment, itis preferable to apply the coating layer to chain plates.

Moreover, in the sliding member in the aforementioned first to another embodiments, it is preferable to apply the coating layer on a surface of teeth of a gear other than a gear of the internal combustion engine (in this case, for example, a gear of an aluminum alloy is used instead of a steel gear, and the coating layer is formed on this aluminum alloy). Examples of the gear other than a gear of the internal combustion engine include differential gears for automobiles, generators for automobiles, and generators other than those for automobiles. Furthermore, the sliding member in the aforementioned first to another embodiments is preferably applied to general sliding bearings (meaning sliding bearings in a broad sense that is not a rolling bearings.).

Next describes a method for manufacturing the sliding member in detail. The method for manufacturing the sliding member is, for example, a method for manufacturing a sliding member in the aforementioned embodiments including the base substrate, and a coating layer formed on the base substrate, wherein the coating layer has a steel portion and a copper portion, or has the steel portion, the copper portion and the hard particle portion, and these portions are bonded to each other via the interface therebetween. This method for manufacturing the sliding member includes a step of forming the coating layer on the base substrate by spraying on the base substrate, in a non-melted state, a mixture containing the aforementioned steel particles and copper particles, or a mixture containing the aforementioned steel particles, copper particles, and hard particles.

As described above, by forming the predetermined coating layer on the base substrate by spraying the mixture in the non-melted state onto the base substrate, it is possible to efficiently form the coating layer excellent in wear resistance. In other words, by forming the coating layer by a method called kinetic spraying, cold spraying, or warm spraying, it is possible to efficiently form a coating layer having excellent wear resistance. However, the sliding member of the present invention is not limited to those manufactured by this method.

A more specific manufacturing method will be described in further details.

As described above, when the mixture is sprayed onto the base substrate, it is preferred that the mixture is sprayed onto the base substrate at a speed that forms a plastically deformed portion on at least one of the base substrate and the coating layer. This thus efficiently forms a coating layer further exceling in wear resistance.

However, the speed for spraying the mixture is not limited to the aforementioned speed. For example, the particle speed preferably ranges from 300 m/s to 1200 m/s, more preferably from 500 m/s to 1000 m/s, still more preferably from 600 m/s to 800 m/s. The pressure of operating gas supplied for spraying the particles preferably ranges from 2 MPa to 5 MPa, more preferably from 3.5 MPa to 5 MPa. If the pressure of the operating gas is less than 2 MPa, a sufficient particle speed cannot be obtained, which may result in a large porosity. However, it is needless to say that these are not limited to the above-mentioned ranges and may be out of these ranges as long as the effects of the present invention can be achieved.

The temperature of the operating gas is not particularly limited, however, for example, ranges preferably from 400° C. to 800° C., more preferably from 600° C. to 800° C. If the temperature of the operating gas is lower than 400° C., the wear resistance may decrease due to the large porosity. If the temperature of the operating gas exceeds 800° C., the nozzle may be clogged. However, it is needless to say that the temperature is not limited to these ranges and may be out of these ranges as long as the effects of the present invention can be achieved.

Furthermore, the type of the operating gas is not particularly limited. Examples of the operating gas include nitrogen and helium. Just one type may be used alone, or a plurality of types may be used in combination. Further, a mixture of fuel gas and nitrogen may also be used.

After the coating layer is formed, the sliding member may be aged or tempered at 250° C. to 500° C. for 0.5 hour to 4 hours, for example. This can improve the wear resistance. This aging or tempering may also be performed, for example, by utilizing heat from a combustion chamber during a test run in an inspection conducted after assembling the engine.

Furthermore, the steel particles used as the material is not particularly limited. However it is preferable to use those in a non-melted state, and made of the aforementioned austenitic stainless steel. The steel particles are preferably in a supersaturated solid solution state. Since the steel particles exhibit high ductility, in other words high deformability, in the supersaturated solid solution state, the coating layer can be formed efficiently, and its film formability may be improved. The particles in the supersaturated solid solution state are not particularly limited. For example, rapidly-solidified particles obtained by rapid solidification such as atomizing are preferably used.

Furthermore, the copper particles used as the material is not particularly limited. However, they are preferably in a non-melted state, and made of the aforementioned pure copper or an alloy containing 50 percent by mass or more of copper.

Furthermore, the hard particles used as the material is not particularly limited. However, they are preferably in a non-melted state, and harder than the steel particles.

Although the grain size (screen size) of the steel particles, copper particles and hard particles used as the materials is not particularly limited, the grain size is preferably not more than 45 μm. Moreover, although not particularly limited, the grain size (screen size) of the steel particles is preferably 11 μm or more. Moreover, although not particularly limited, the grain size (screen size) of the hard particles is preferably 11 μm or more.

EXAMPLES

The following describes the present invention in further detail with Test Examples. However, the present invention is not limited to these Test Examples.

Text Example 1

First, austenitic stainless steel particles (SUS316L, gas-atomized particles, grain size (screen size) −45/+11 (μm)) were prepared as the steel particles serving as the material.

Moreover, copper particles (Cu, gas-atomized particles, grain size (screen size) −45(μm)) were prepared as the copper particles serving as the material.

Meanwhile, a preprocessed aluminum base substrate was prepared by preprocessing an aluminum base substrate (Japanese Industrial Standards H 4040 A5056) assuming a target thickness of a coating layer of 0.2 mm in a state, in which processing of a seat portion for an engine valve of a cylinder head is completed.

Then, the prepared aluminum base substrate was mounted on a rotating table, and a mixture of the prepared steel particles and copper particles (steel particles:copper particles:hard particles=90:10:0 (mass ratio)) was sprayed onto the prepared aluminum base substrate with a high-pressure cold spray device (Kinetiks 4000 manufactured by CGT, operating gas—type: nitrogen, temperature: 650° C., pressure: 3.5 MPa) while rotating the rotating table, to form a coating layer with a thickness of 0.4 mm to 0.5 mm on the base substrate.

Thereafter, the coating layer was finished by machining into the actual shape of the seat portion for the engine valve of the cylinder head, to obtain the sliding member of the present Example. The thickness of the coating layer was 0.2 mm (the same applies hereinafter).

Text Examples 2 to 4

The sliding member for each Example were obtained by repeating the same operations as Example 1, except that the specifications of the steel particles, copper particles and hard particles and film formation conditions were altered as shown in Table 1.

Test Examples 5 to 7, Comparative Example 1

The sliding member for each Example were obtained by repeating the same operations as Example 1, except that the specifications of the steel particles, copper particles and hard particles and film formation conditions were altered as shown in Table 2.

Comparative Examples 2 to 6

The sliding member for each Example were obtained by repeating the same operations as Example 1, except that the specifications of the steel particles, copper particles and hard particles and film formation conditions were altered as shown in Table 3.

TABLE 1

| | | Test Example 1 | Test Example 2 | Test Example 3 | Test Example 4 |
|---|---|---|---|---|---|
| Steel particles | Material type | SUS316L | SUS316L | SUS316L | SUS316L |
| | Particle manufacturing method | Gas atomizing | Gas atomizing | Gas atomizing | Gas atomizing |
| | Grain size (screen size) (μm) | −45/+11 | −45/+18 | −45/+11 | −45/+11 |
| Copper particles | Material type | Cu | Cu | Cu | Cu-38Ni |
| | Particle manufacturing method | Gas atomizing | Gas atomizing | Gas atomizing | Gas atomizing |
| | Grain size (screen size) (μm) | −45 | −45 | −45 | — |
| Hard particles | Material type | — | Tribaloy T-400 | Ni700 (Ni-32Mo-16Cr-3.1Si) | Stellite 6 |
| | Particle manufacturing method | — | Gas atomizing | Gas atomizing | Gas atomizing |
| | Grain size (screen size) (μm) | — | −45/+20 | −45/+15 | −45/+11 |
| Film formation conditions | Mixed proportion (mass ratio) Steel particles:Copper particles:Ilard particles | 90:10:00 | 60:10:30 | 60:10:30 | 60:10:30 |
| | Gas temperature (° C.) | 650 | 750 | 650 | 650 |
| | Gas pressure (MPa) | 3.5 | 3.6 | 3.5 | 3.5 |
| | Adhesion | — | 51% | — | — |
| | Coating layer quality | — | — | — | — |
| Coating layer | Vickers hardness of Steel part (HV 0.1) | — | 347 | 357 | 381 |
| | Vickers hardness of Copper part (HV 0.010) | — | 93 | 93 | 200 |
| | Vickers hardness of Hard particle part (HV 0.025) | — | 792 | 779 | 676 |
| Wear Evaluation | N = 1 Wear resistance (Valve seat wear loss (μm)) | 63.6 | 21.0 | 20.5 | 21.2 |
| | Mating aggression (Valve face wear loss (μm)) | 12.1 | 2.2 | 1.1 | 3.8 |
| | N = 2 Wear resistance (Valve seat wear loss (μm)) | — | — | 16.0 | 47.0 |
| | Mating aggression (Valve face wear loss (μm)) | — | — | 2.6 | 5.7 |
| | N = 3 Wear resistance (Valve seat wear loss (μm)) | — | — | 22.0 | — |
| | Mating aggression (Valve face wear loss (μm)) | — | — | 5.1 | — |
| | N = 4 Wear resistance (Valve seat wear loss (μm)) | — | — | 33.8 | — |
| | Mating aggression (Valve face wear loss (μm)) | — | — | 3.1 | — |

TABLE 2

| | | Test Example 5 | Test Example 6 | Test Example 7 | Comparative Example 1 |
|---|---|---|---|---|---|
| Steel particles | Material type | SUS316L | SUS316L | SUS316L | SUS316L |
| | Particle manufacturing method | Gas atomizing | Gas atomizing | Water atomizing | Gas atomizing |
| | Grain size (screen size) (μm) | −45/+11 | −45/+11 | −45/+18 | −45/+18 |
| Copper particles | Material type | Cu | Cu-38Ni | — | — |
| | Particle manufacturing method | Gas atomizing | Gas atomizing | — | — |
| | Grain size (screen size) (μm) | −45 | — | — | — |
| Hard particles | Material type | Fe-28Cr-16Ni-4.5Mo-1.5Si-1.75C | Ni700 (Ni-32Mo-16Cr-3.1Si) | Tribaloy T-400 | — |

TABLE 2-continued

| | | | Test Example 5 | Test Example 6 | Test Example 7 | Comparative Example 1 |
|---|---|---|---|---|---|---|
| | | Particle manufacturing method | Gas atomizing | Gas atomizing | Water atomizing | — |
| | | Grain size (screen size) (μm) | — | −45/+15 | −45/+20 | — |
| Film formation conditions | | Mixed proportion (mass ratio) Steel particles:Copper particles:Hard particles | 60:10:30 | 60:10:30 | 70:0:30 | 100:0:0 |
| | | Gas temperature (° C.) | 650 | 650 | 750 | 750 |
| | | Gas pressure (MPa) | 3.5 | 3.5 | 3.6 | 3.6 |
| | | Adhesion | — | — | 54% | 72% |
| | | Coating layer quality | — | — | — | — |
| Coating layer | | Vickers hardness of Steel part (HV 0.1) | 367 | 390 | 354 | — |
| | | Vickers hardness of Copper part (HV 0.010) | 106 | 211 | — | — |
| | | Vickers hardness of Hard particle part (HV 0.025) | 624 | 836 | — | — |
| Wear Evaluation | N = 1 | Wear resistance (Valve seat wear loss (μm)) | 19.5 | 32.0 | 72.2 | 80.7 |
| | | Mating aggression (Valve face wear loss (μm)) | 5.8 | 3.8 | 15.2 | 4.8 |
| | N = 2 | Wear resistance (Valve seat wear loss (μm)) | 43.5 | 35.3 | — | — |
| | | Mating aggression (Valve face wear loss (μm)) | 2.1 | 1.9 | — | — |

TABLE 3

| | | | Comparative Example 2 | Comparative Example 3 | Comparative Example 4 | Comparative Example 5 | Comparative Example 6 |
|---|---|---|---|---|---|---|---|
| Steel particles | | Material type | CoNiCrAlY (Co alloy) | Pure iron (Ferrite) | Fe-Si-B-Cr-based amorphous | SKH51 (High-speed tool steel) | SUS440C (Martensitic stainless steel) |
| | | Particle manufacturing method | Water atomizing | Gas atomizing | Water atomizing | Water atomizing | Water atomizing |
| | | Grain size (screen size) (μm) | −45 | −45 | −20 | −45 | −45 |
| Copper particles | | Material type | — | — | — | — | — |
| | | Particle manufacturing method | — | — | — | — | — |
| | | Grain size (screen size) (μm) | — | — | — | — | — |
| Hard particles | | Material type | — | — | — | — | — |
| | | Particle manufacturing method | — | — | — | — | — |
| | | Grain size (screen size) (μm) | — | — | — | — | — |
| Film formation conditions | | Mixed proportion (mass ratio) Steel particles:Copper particles:Hard particles | 100:0:0 | 100:0:0 | 100:0:0 | 100:0:0 | 100:0:0 |
| | | Gas temperature (° C.) | 750 | 750 | 750 | 750 | 750 |
| | | Gas pressure (MPa) | Less than 1 MPa | Less than 1 MPa | Less than 1 Mpa | Less than 1 Mpa | Less than 1 Mpa |
| | | Adhesion | 30% or less | — | 30% or less | | |
| | | Coating layer quality | Cracks and peeling occurred | — | Cracks and peeling occurred | | |
| Coating layer | | Vickers hardness of Steel part (HV 0.1) | — | — | — | — | — |
| | | Vickers hardness of Copper part (HV 0.010) | — | — | — | — | — |
| | | Vickers hardness of Hard particle part (HV 0.025) | — | — | — | — | — |
| Wear Evaluation | N = 1 | Wear resistance (Valve seat wear loss (μm)) | 350.1 | 220.0 | 375.8 | 25.0 | 26.6 |
| | | Mating aggression (Valve face wear loss (μm)) | 11.4 | 11.5 | 6.0 | 11.3 | 6.8 |

The Vickers hardness of the steel portion, the copper portion and the hard particle portion in the coating layer of each Example in Tables 1 and 3 were measured and calculated according to the Vickers hardness test defined in the Japanese Industrial Standards (JIS Z 2244). In order to calculate an arithmetic mean, measurements were made at ten points. Moreover, observations of scanning electron microscope (SEM) images and transmission electron microscope (TEM) images, and results of energy dispersive X-ray (EDX) spectrometry were used in determining the measuring points. The presence or absence of at least one of a diffusion layer and an intermetallic compound layer in the base substrate of the sliding member and in the steel portion, the copper portion, and the hard particle portion of the sliding member of each Example was specified by the observation of a transmission electron microscopic (TEM) image of the cross section of the sliding member and energy dispersive X-ray (EDX) analysis. Furthermore, the presence or absence of a plastically deformed portion in the cross section of the sliding member of each Example was determined by the observation of the cross-sectional scanning electron microscopic (SEM) image and energy dispersive X-ray (EDX) analysis. In all of Test Examples 1 to 7, at least one of a diffusion layer and an intermetallic compound layer was observed, and a plastically deformed portion was observed in the base substrate and the coating layer. In Tables 1, and 2, Tribaloy T-400 and Stellite 6 are manufactured by Kennametal Stellite, and Ni700 is manufactured by Sandvik.

Performance Evaluation

The following performances were evaluated for the aforementioned sliding member of each Example.

Wear Evaluation (Wear Resistance and Mating Aggression)

Figure 14:
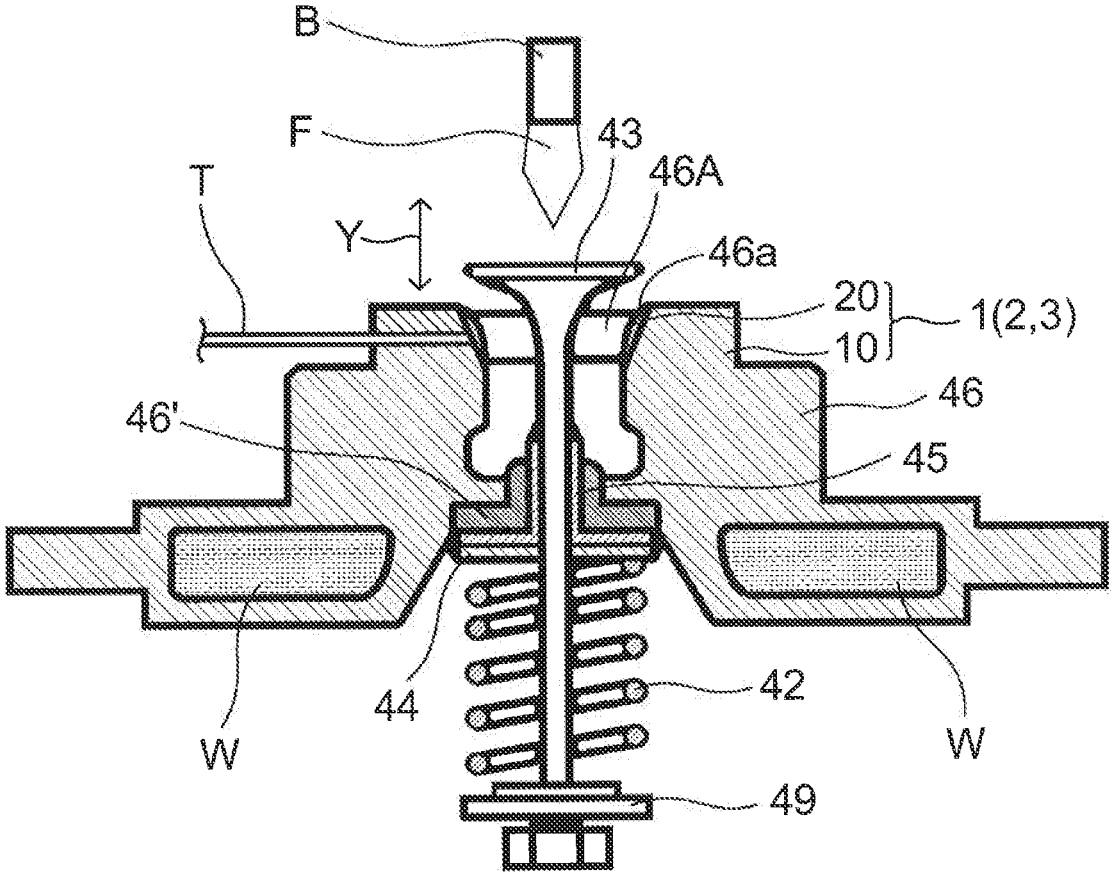
FIG. 14 is a cross-sectional view illustrating an overview of a wear tester.

FIG. 14 is a cross-sectional view illustrating the outline of a wear tester. As illustrated in FIG. 14, a wear tester resembling a valve actuating mechanism of an engine is fabricated from actual engine parts such as a valve spring 42, an engine valve 43, a stem seal 44, a valve guide 45, cylinder heads 46, 46' and a cotter 49. The sliding member (1, 2, 3) of the Examples were applied as a seat portion 46A for the engine valve 43 of the cylinder head 46. The sliding member (1, 2, 3) includes the predetermined coating layer 20 formed on the base substrate 10. The engine valve 43 is in an open state in the figure. The engine valve 43 reciprocates in a vertical direction as illustrated by the arrow Y in the figure by means of an eccentric cam (not shown) so that the engine valve 43 repeatedly opens and closes. The sliding surface 46*a* of the seat portion 46A for the engine valve 43 of the cylinder head 46 is under a high-temperature environment by means of a flame F of a gas burner B. The temperature of the seat portion 46A is measured with a thermometer T. Cooling water W circulates within the cylinder head 46.

The wear loss was measured and calculated with the aforementioned wear tester under the following test conditions. Specifically, the shape of the seat portion for the engine valve (valve seat) of the cylinder head and a valve face of the engine valve was acquired with a shape measuring instrument before and after the test. The wear loss was measured at four points, and the average thereof was calculated to serve as the wear loss. The results are shown in Tables 1 to 3.

Test Conditions

Temperature: 300° C. (Assuming a seat portion for an engine valve of a cylinder head on an exhaust port side.);
Number of inputs: 540000 times.

As seen from Tables 1 to 3, Test Examples 1 to 6 within the scope of the present invention exhibited less wear loss than Comparative Example 1, which is outside of the scope of the present invention, and had excellent wear resistance even at high temperatures. Moreover, Test Example 7 also exhibited less wear loss than Comparative Example 1, and had excellent wear resistance even at high temperatures. Furthermore, Test Examples 2 to 6 exhibited excellent wear resistance and mating aggression.

It is considered that the sliding members with excellent wear resistance as Examples 1 to 6 were obtained, because the coating layer was formed on the base substrate, the coating layer including the aforementioned predetermined steel portion and copper portion, and these portions being bonded to each other via the interface therebetween.

Furthermore, it is considered that the sliding members with excellent wear resistance and mating aggression as Examples 2 to 6 were obtained, because the coating layer was formed on the base substrate, the coating layer including the aforementioned predetermined steel portion, copper portion and hard particle portion, and these portions being bonded to each other via interfaces therebetween.

Figure 15:
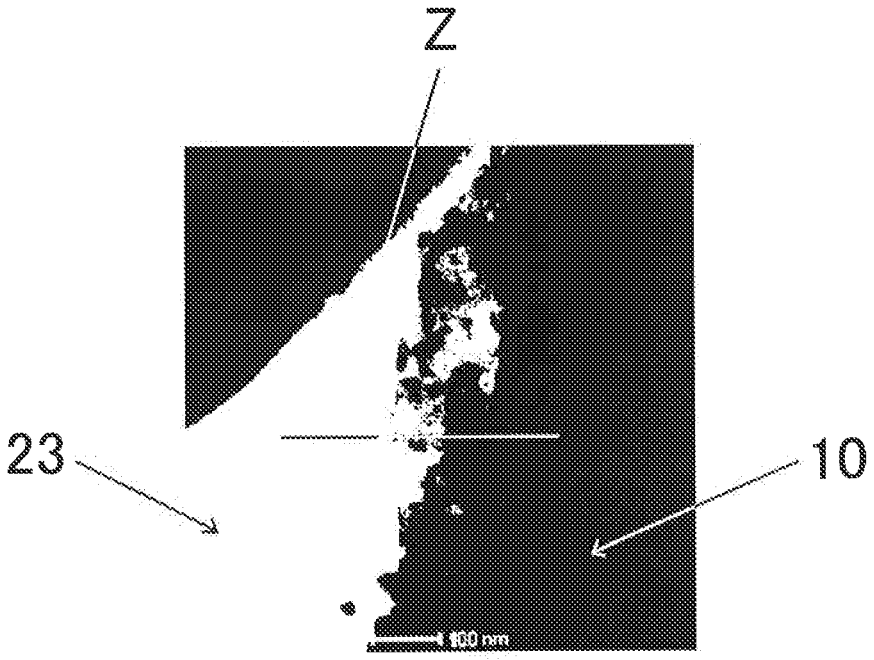
FIG. 15 is a transmission electron microscopic (TEM) cross-sectional image of the sliding member of Test Example2.
Figure 16:
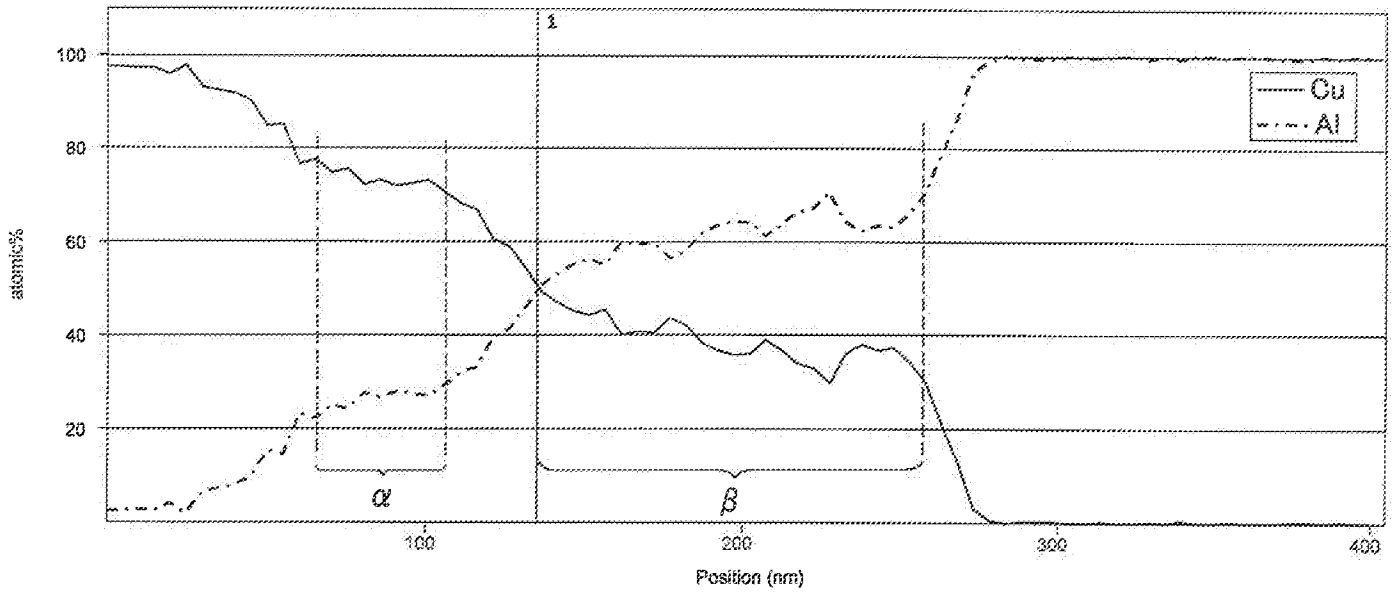
FIG. 16 is a graph illustrating the result of an energy dispersive X-ray (EDX) analysis of the sliding member of Text Example 2.

FIG. 15 is a transmission electron microscopic (TEM) cross-sectional image around the interface between the base substrate and the coating layer of the sliding member of Test Example 2, more specifically, around the interface between the base substrate 10 and the copper portion 23 in the coating layer. FIG. 16 is a graph showing the result of an energy dispersive X-ray (EDX) analysis (linear analysis) of the sliding member of Test Example 2 along the line Z in FIG. 15. The point 1 in FIG. 15 and the point 1 in FIG. 16 indicate the same point.

Since the ratio of copper and aluminum at part α is approximately Cu:Al=9:4 (atomic ratio) from FIGS. 15 and 16, it is considered that an intermetallic compound layer of $Cu_9Al_4$ was formed. Moreover, since the ratio of copper and aluminum at part β is approximately Cu:Al=1:2 (atomic ratio) from FIGS. 15 and 16, it is considered that an intermetallic compound layer of $CuAl_2$ was formed. In each of the regions containing the part α and part β, a region with even contrast could be observed in the HAADF image.

Moreover, it is also considered that the sliding members with the excellent wear resistance as Test Examples 1 to 6 were obtained, because at least one of the base substrate and the coating layer has a plastically deformed portion.

Furthermore, it is also considered that the sliding members with the excellent wear resistance as Test Examples 1 to 6 were obtained, because the hard particle portion includes hard particles such as iron-based alloy, cobalt-based alloy, and nickel-based alloys.

Moreover, it is also considered that the sliding members with the excellent wear resistance as Test Examples 1 to 6 were obtained, because at least a part of at least one type selected from the group consisting of the base substrate, the steel portion, the copper portion and the hard particle portion has at least one of a diffusion layer and an intermetallic compound layer.

Furthermore, it is also considered that the sliding members with excellent wear resistance as Test Examples 1 to 6 were obtained, because the manufacturing method of the aforementioned sliding member includes a step of spraying, onto the base substrate, the aforementioned mixture in a non-melted state, to form a coating layer on the base substrate.

Furthermore, it is also considered that the sliding member with excellent wear resistance as Test Examples 1 to 6 were obtained, because, when spraying the aforementioned mixture onto the base substrate, the mixed powder was sprayed onto the base substrate at a speed that forms a plastically deformed portion on at least one of the base substrate and the coating layer.

Furthermore, from the results of the adhesion rate and the coating layer quality in Test Examples 2, 7, Comparative Examples 1, 2, and 4 to 6, it can be seen that Text Examples 1 to 6 within the scope of the present invention efficiently form a coating layer that does not easily crack or peel off.

While the present invention is described with some embodiments and test examples, the present invention is not limited thereto, and a variety of variations can be made within the scope of the present invention.

For example, the components described in the aforementioned embodiments and test examples are not limited to the individual embodiments and test examples. For example, detailed specifications of the steel particles, copper particles and hard particles as well as details of film forming conditions may be changed. Further, the components of each embodiment or each Test Example may be combined differently from the combinations in the aforementioned embodiments and Test Examples.

REFERENCE SIGNS LIST

1,2,3: Sliding member
10: Base substrate
10*b*: Plastically deformed portion
11: Diffusion layer and/or Intermetallic compound layer

20: Coating layer
20*a*,20*b*: Plastically deformed portion
20*c*: Pore
21: Steel portion
22: Diffusion layer and/or Intermetallic compound layer
23: Copper portion
24: Diffusion layer and/or Intermetallic compound layer
25: Hard particle portion
26: Diffusion layer and/or Intermetallic compound layer
40: Cam lobe
41: Valve lifter
42: Valve spring
43: Engine valve
43A: Valve stem
43*a*: Sliding surface
43B: Valve face
43*b*: Sliding surface
44: Stem seal
45: Valve guide
45*a*: Sliding surface
46,46'; Cylinder head
46A: Seat portion
46*a*: Sliding surface
47: Exhaust port
48: Retainer
49: Cotter
60: Connecting rod
60A: Big end portion
61: Crank pin
62: Bearing metal
62*a*: Sliding surface
B: Gas burner
F: Flame
T: Thermometer
W: Cooling water

The invention claimed is:

1. A sliding member, comprising:

a base substrate; and a coating layer formed on a sliding portion of the base substrate, wherein the coating layer includes a steel portion derived from austenitic stainless steel particles and a copper portion derived from copper particles or copper alloy particles, and the steel portion and the copper portion are bonded to each other via a first intermetallic compound layer including a constituent element constituting the steel portion and a constituent element constituting the copper portion at an interface between the steel portion and the copper portion, and the base substrate and the steel portion are bonded to each other via a second intermetallic compound layer at an interface between the base substrate and the steel portion and/or the base substrate and the copper portion are bonded to each other via a third intermetallic compound layer at an interface between the base substrate and the copper portion.

2. The sliding member according to claim 1, wherein the coating layer includes a hard particle portion derived from hard particles, the hard particle portion being harder than the steel portion.

3. The sliding member according to claim 1, wherein at least one of the base substrate and the coating layer includes a plastically deformed portion.

4. The sliding member according to claim 2, the hard particles comprising at least one type of hard particles selected from the group consisting of iron-based alloy particles, cobalt-based alloy particles, chromium-based alloy particles, nickel-based alloy particles, molybdenum-based alloy particles, or ceramic particles.

5. The sliding member according to claim 2, wherein the base substrate and the hard particle portion are bonded to each other via a fourth intermetallic compound layer at an interface between the base substrate and the hard particle portion.

6. A sliding member for an internal combustion engine, comprising the sliding member according to claim 1 in a sliding portion of the internal combustion engine.

7. The sliding member according to claim 2, wherein the steel portion and the hard particle portion are bonded to each other via a fourth intermetallic compound layer at an interface between the steel portion and the hard particle portion.

8. The sliding member according to claim 2, wherein the copper portion and the hard particle portion are bonded to each other via a fourth intermetallic compound layer at an interface between the copper portion and the hard particle portion.

* * * * *